US005797529A

United States Patent [19]

Lavine

[11] Patent Number: 5,797,529

[45] Date of Patent: Aug. 25, 1998

[54] CONVERTIBLE MULTI-USE BAG

[76] Inventor: Edward L. Lavine, 830 Greensward Ct. #H-215, Delray Beach, Fla. 33445-9038

[21] Appl. No.: 753,179

[22] Filed: Nov. 20, 1996

[51] Int. Cl.[6] ..... A45C 15/00; A45F 4/00

[52] U.S. Cl. ..... 224/575; 224/153; 224/581; 190/103; 190/107; 383/4

[58] Field of Search ..... 224/153, 575, 224/577, 581, 582, 209; 190/103, 107, 110, 114; 383/4; 294/141

[56] References Cited

U.S. PATENT DOCUMENTS

| | | | |
|---|---|---|---|
| 1,537,956 | 5/1925 | McNally | 383/4 |
| 1,606,107 | 11/1926 | Simms | 383/4 |
| 2,105,319 | 1/1938 | Hedden et al. | 224/46 |
| 2,557,280 | 6/1951 | Hahn | 383/4 |
| 4,153,146 | 5/1979 | Patton et al. | 190/44 |
| 4,334,601 | 6/1982 | Davis | 190/44 |
| 4,515,300 | 5/1985 | Cohen | 224/151 |
| 4,756,394 | 7/1988 | Cohen | 190/18 A |
| 4,782,874 | 11/1988 | Chartier | 150/112 |
| 4,951,816 | 8/1990 | Smith | 190/103 |
| 5,150,824 | 9/1992 | Alvarez et al. | 224/151 |
| 5,399,020 | 3/1995 | Cheng | 383/4 |
| 5,425,449 | 6/1995 | Boorady | 206/287.1 |
| 5,490,619 | 2/1996 | Bovar | 224/153 |
| 5,577,652 | 11/1996 | Cooper | 224/153 |

*Primary Examiner*—David J. Walczak
*Assistant Examiner*—Timothy L. Maust
*Attorney, Agent, or Firm*—Wolf, Greenfield & Sacks, P.C.

[57] ABSTRACT

A backpack which is convertible to a totebag and to a fanny pack, the backpack comprising parallel front and rear panels each having upper and lower edges, means for joining peripheries of said panels to form a compartment therebetween, at least one closeable opening in said front panel to allow access to said compartment, first fastening means disposed along the upper edge of said rear panel, second fastening means disposed along the lower edge of said front panel, third fastening means disposed along the upper edge of said front panel and fourth fastening means disposed on said front panel intermediate said second and third fastening means, wherein said backpack is converted to said totebag when said first and second fastening means are fastened together proximate a midline of said rear panel, and further converted to said fanny pack when said totebag is folded in half and said third and fourth fastening means are fastened together.

25 Claims, 10 Drawing Sheets

CONVERTIBLE MULTI-USE BAG

FIELD OF THE INVENTION

The present invention relates to a multi-use bag which is convertible into several different forms.

BACKGROUND OF THE INVENTION

Sometimes it is desirable, either while traveling or engaging in outdoor or sporting activities, to carry supplies in some type of pack. Depending on the amount and/or nature of supplies necessary for the particular activity which is being undertaken, different size packs may be needed. Frequently, the amount of supplies necessary for the activity may either decrease during the activity as supplies are used up, or the number of supplies may increase such as while shopping, etc. Under these circumstances, it would be ideal to adjust the volume of the pack being used in order to better provide for the amount of volume needed.

Many convertible bags are available which are directed to the problems set forth above. Some bags use a system of straps or buckles which are used to vary the volume of the bag. Other bags have compartments or pockets for holding larger compartments or pockets which fold out of the smaller compartments. However, in such bags, when the larger pocket is to be folded back into the smaller pocket, the larger pocket must be folded precisely as it was originally packaged or the larger pocket will not fit properly into the smaller pocket, thus increasing the bulk of the bag and decreasing the volume of the smaller pocket Other multi-use bags heretofore in use include detachable bags and removable panels used to expand or contract the useful volume of the bag. Such an arrangement, as suggested in U.S. Pat. No. 4,756,394, issued Jul. 12, 1988, and U.S. Pat. No. 4,515,300, issued May 7, 1995, can be bulky and cumbersome to assemble as both disclose larger pockets which are folded into smaller pockets. U.S. Pat. No. 5,150,824, issued Sep. 29, 1992, discloses a fanny pack which is expandable by unfolding larger pockets, but the pack remains a fanny pack, and the extra pockets obtained by unfolding the pack can be awkward to carry as the pocket hangs from the fanny pack, thus possibly hindering the activity of the wearer of the fanny pack.

SUMMARY OF THE INVENTION

Thus it is desirable to provide a convertible multi-use bag capable of being converted into several different types of bags having different capacities which is simple to convert, does not require folding and stuffing a larger, bulkier pocket into a smaller pocket, and which is conventionally shaped and used. In one embodiment of the invention, a convertible bag is provided with means for simple conversion to one of three arrangements including, a fanny pack, a tote bag, and a backpack depending upon the particular use desired.

In a preferred embodiment, a backpack is disclosed which is convertible to a totebag and to a fanny pack, the backpack comprising parallel front and rear panels having upper and lower edges, means for joining peripheries of the panels to form a compartment therebetween, at least one closeable opening in the front panel to allow access to the compartment, first fastening means disposed along the upper edge of the rear panel, second fastening means disposed along the lower edge of the front panel, third fastening means disposed along the upper edge of the front panel and fourth fastening means disposed on the front panel intermediate the second and third fastening means, wherein the backpack is converted to the totebag when the first and second fastening means are fastened together proximate a midline of the rear panel, and further converted to the fanny pack when the totebag is folded in half and the third and fourth fastening means are fastened together.

The backpack may include first and second strap attachment means disposed near the upper and the lower edge of the rear panel, respectively, to allow a pair of shoulder straps to be attached between the first and second strap attachment means. The joining means may be gussetted to allow the compartment to be expanded and collapsed between the front and rear panels. The joining means may include a closeable opening disposed between the upper edges of the front and rear panels. The backpack may include a third strap attachment means disposed near the upper edge of the front panel to allow a shoulder strap of the totebag to be attached between the third strap attachment means. The third strap attachment means may be attached to the joining means adjacent the third fastening means. The backpack may include a gussetted pocket attached to the front panel intermediate the third and fourth fastening means. The backpack may include fifth fastening means disposed between the upper and lower edges of the rear panel and parallel to the top edge. The profile of the backpack may be modified by fastening together the first and third fastening means or by fastening together the first and fifth fastening means.

In another embodiment, a multi-use bag convertible into three configurations is disclosed, the bag comprising parallel front and rear panels having upper and lower edges, means for joining the panels along their peripheries to form a compartment therebetween, and at least one closeable opening in one of the panels for access to the compartment, the bag functioning as a backpack in an unfolded position, means for fastening the upper and lower edges together proximate a midline of the rear panel, thereby forming a tote bag having an upper end, a lower end and at least one closeable opening for access to at least a portion of the compartment, and means for fastening the upper and lower ends of the tote bag together when the tote bag is folded in half, thereby forming a fanny pack having at least one closeable opening for access to at least a portion of the compartment.

In another embodiment, a convertible multi-use bag is disclosed having parallel front and rear panels, means joining the panels along their respective peripheries and defining a backpack compartment having an upper and lower end and a closeable opening in the compartment at the upper end thereof, means for securing the upper and lower ends of the bag together to form a tote bag compartment when the upper and lower ends are folded toward one another, the securing means therefore including a means having one half at the upper end of the panels and the other half at the lower end of the panels, and means for securing the bag to form a fanny pack compartment when the front and rear panels are thrice folded, the securing means for the fanny pack compartment including a means having one half at the upper end of the panels and the other half intermediate the ends of the panels, and means forming a fanny pack on one of the panels intermediate its ends.

In another embodiment, a multipurpose bag selectively convertible to backpack, tote bag and fanny pack configurations is disclosed comprising facing front and rear panels having upper and lower edges, means joining the panels along their peripheries to form a compartment therebetween, a first closeable opening in one of the panels for access to the compartment, the bag functioning as a backpack in an unfolded position, means for securing the upper and lower edges together when the panels are folded whereby the bag functions as a tote bag having upper and lower edges, a second closeable opening in one of the panels for access to at least a portion of the compartment when in the tote bag configuration, and means for securing together the upper and lower edges defining the tote bag when the panels are thrice folded whereby the bag functions as a fanny pack, and means defining an accessible compartment when in the fanny pack configuration.

In yet another embodiment, a method for converting a backpack into a tote bag and a fanny pack is disclosed, the backpack having parallel front and rear panels each having upper and lower edges, the panels being joined along a periphery of each panel to form a compartment therebetween which is accessible through a closeable opening in at least one of the panels, the method comprising folding the top half of the front and rear panels in half, folding the bottom half of the front-and rear panels in half, fastening the upper edge of the rear panel to the lower edge of the front panel proximate a midline of the backpack to form the tote bag, the tote bag having an access to at least a portion of the compartment, folding the tote bag in half and fastening the upper edge of one panel to the same panel at a point intermediate the upper and lower edges of the same panel to form the fanny pack, the fanny pack having an access to at least a portion of the compartment.

DETAILED DESCRIPTION

Figure 1A:
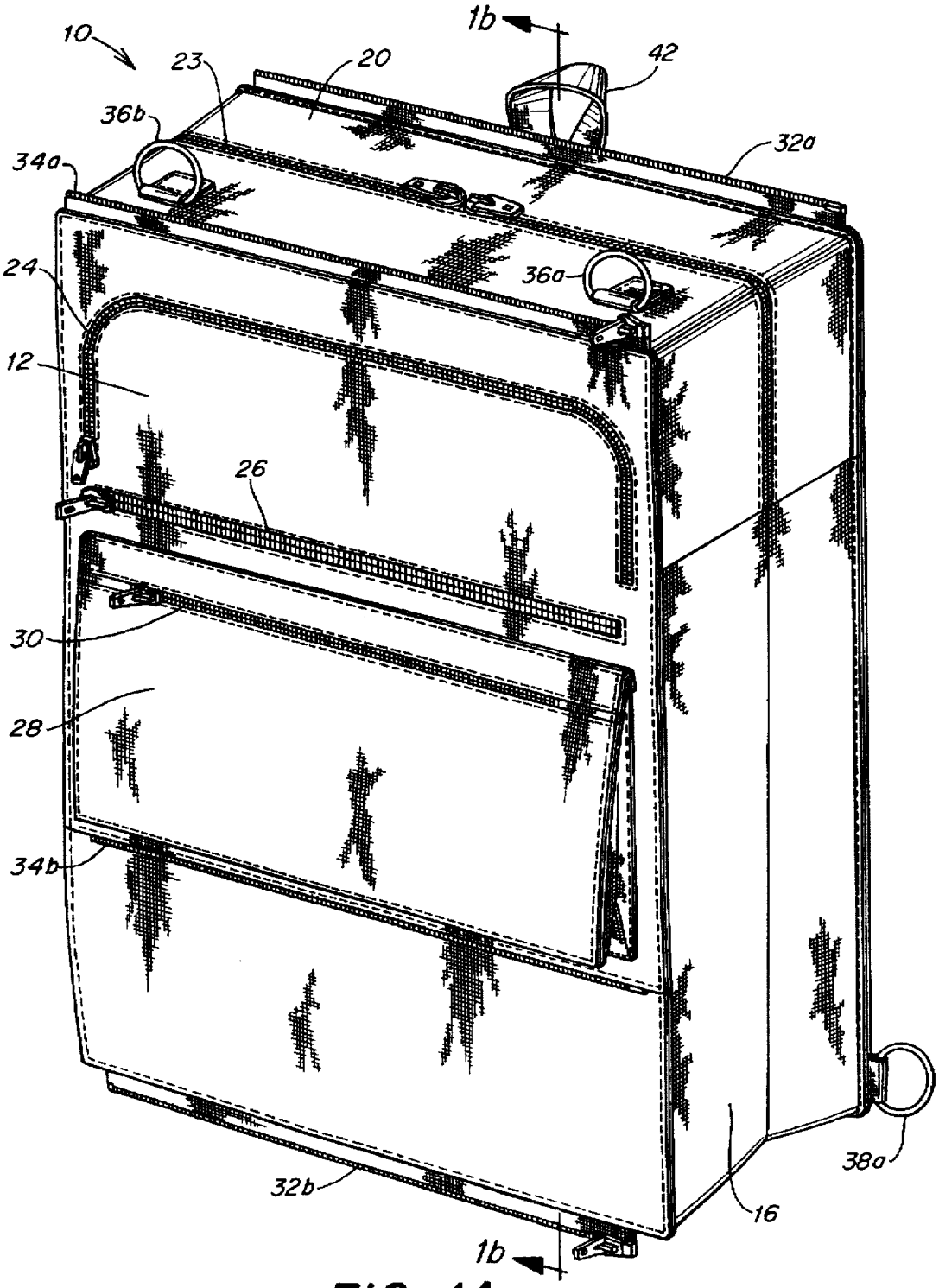
FIG. 1A is a schematic of the bag in a backpack configuration.
Figure 1B:
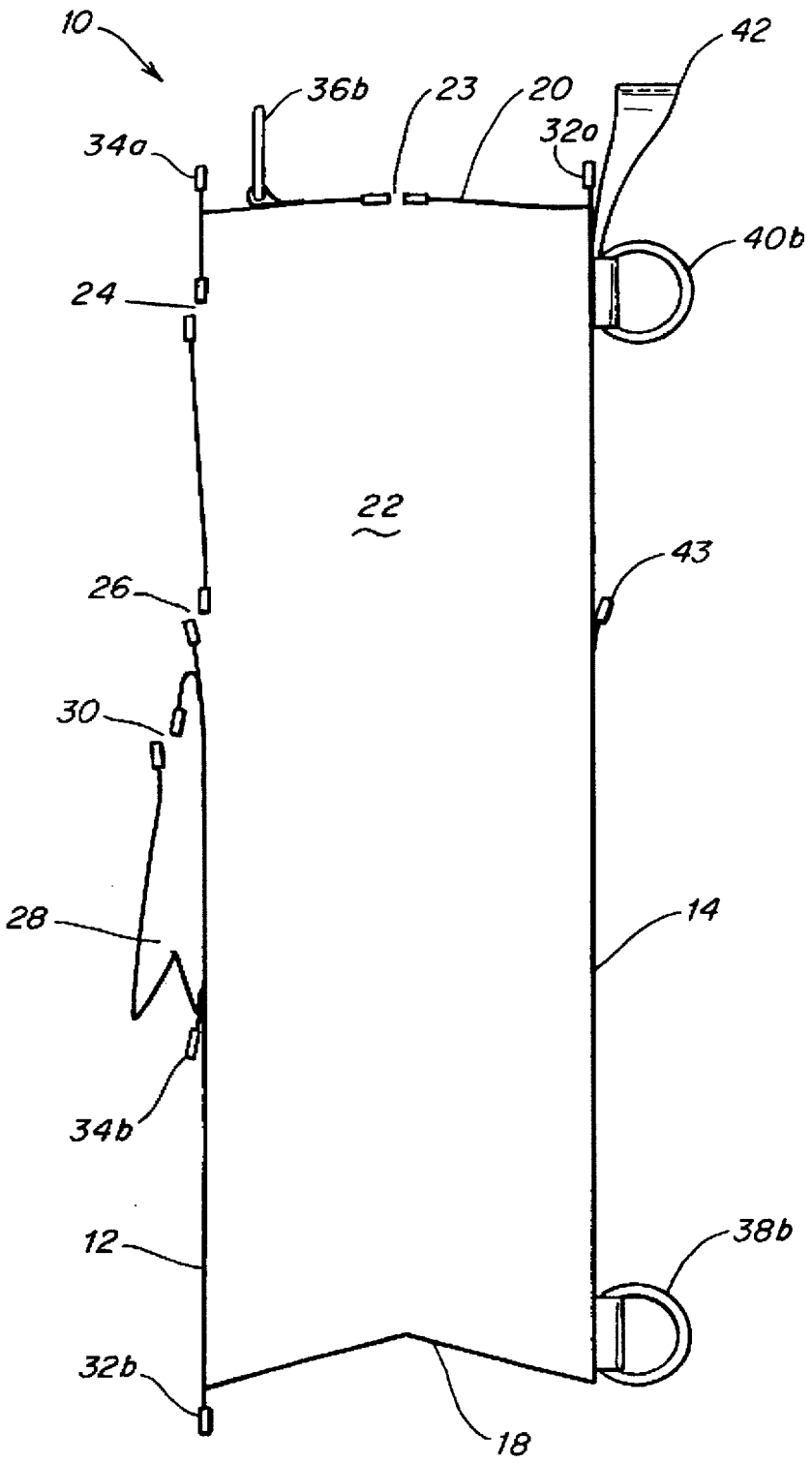
FIG. 1B is a partial schematic showing a cross-section of the backpack of FIG. 1A along line 1*b*—1*b* of FIG. 1A.
Figure 1C:
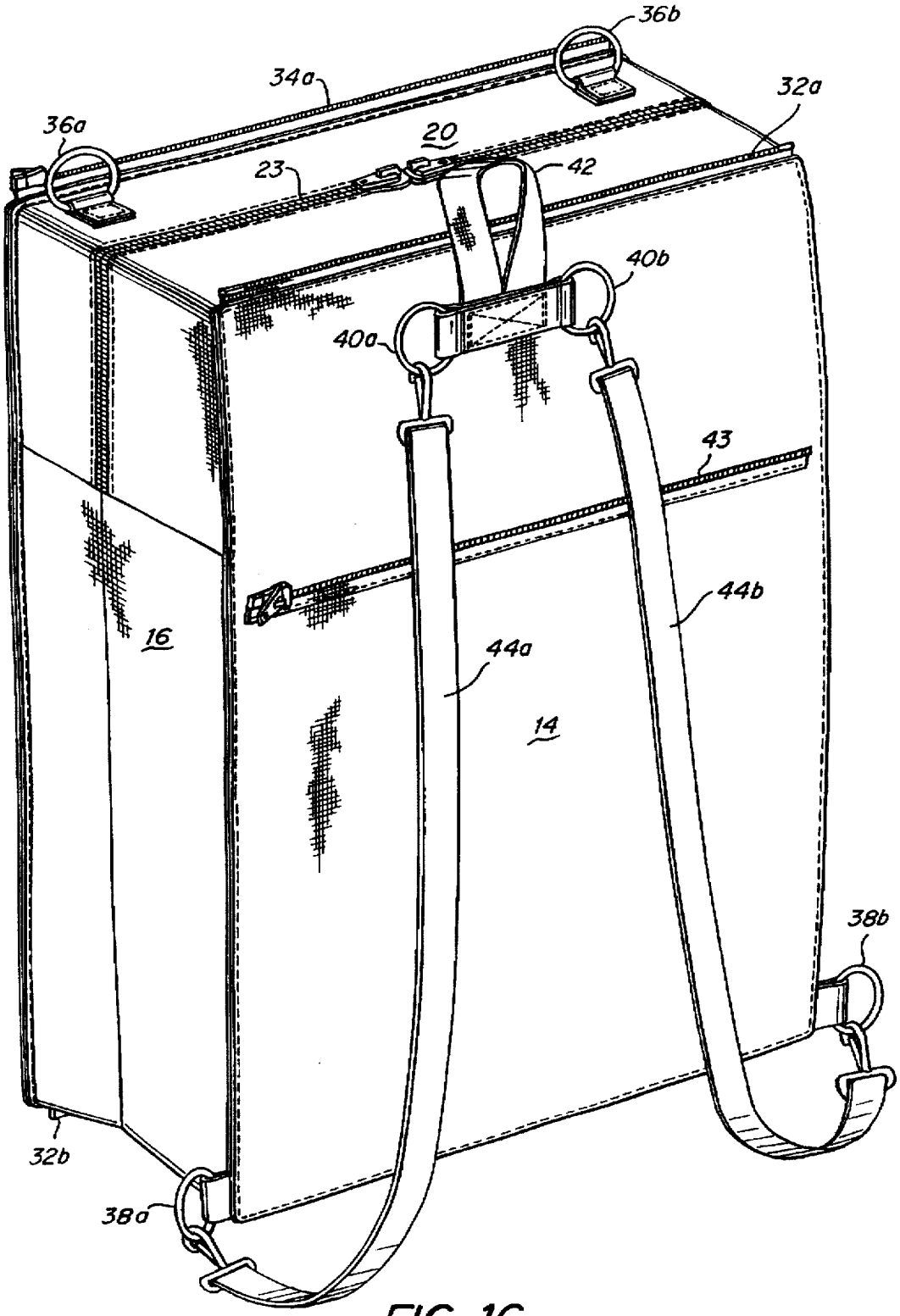
FIG. 1C is a schematic of a rear view of the backpack.

FIGS. 1A-1C show the present invention in its backpack configuration 10. The backpack includes a front panel 12 and a rear panel 14 which are attached to each other along their edges by gussetted side panel 16, gussetted bottom panel 18 and top panel 20 to define an interior section 22, shown in FIG. 1B, which is a schematic showing a cross-section of backpack 10 along line 1*b*—1*b* of FIG. 1A. Front panel 12 includes zippered openings 24 and 26, and top panel 20 includes zippered opening 23 which allow access into interior portion 22. A separate gussetted pocket 28 is attached to front panel 12 and includes zippered opening 30 which opens to allow access into pocket 28. Attached to the upper edge of rear panel 14 is zipper portion **32*a*, attached to the lower edge of front panel 12 is zipper portion 32*b*, which mates with zipper portion 32*a*. Attached to the upper edge of front panel 12 is zipper portion 34*a* and attached to front panel 12 below gussetted pocket 28 is its mated zipper portion 34*b*. Rings 36*a* and 36*b* are attached to top panel 20 adjacent to zipper portion 34*a*. Rings 38*a* and 38*b* are attached to the lower end of rear panel 14 at either side of the panel. Rings 40*a* and 40*b* (FIG. 1C) are attached to the center of the upper portion of rear panel 14 adjacent zipper portion 32*a* Loop 42, which is used as a carrying handle, is attached between rings 40*a* and 40*b*. Zipper portion 43 is attached to rear panel 14 approximately one-third of the way down from top panel 20. Strap 44*a* is attached between rings 38*a* and 40*a* and strap 44*b* is attached between rings 38*b* and 40*b*** to function as shoulder straps for the backpack.

Figure 2A:
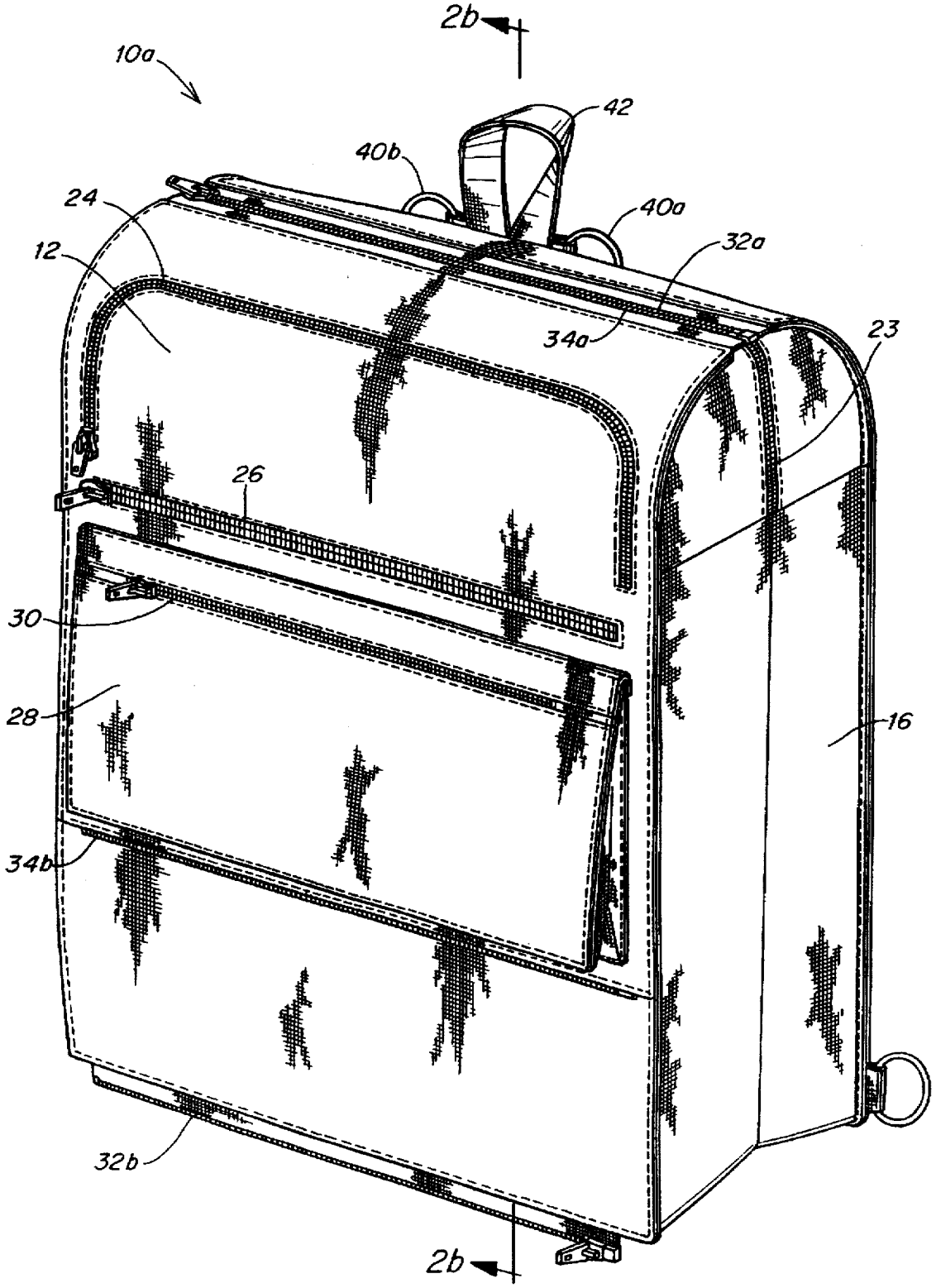
FIG. 2A is a schematic of a modified form of the backpack.
Figure 2B:
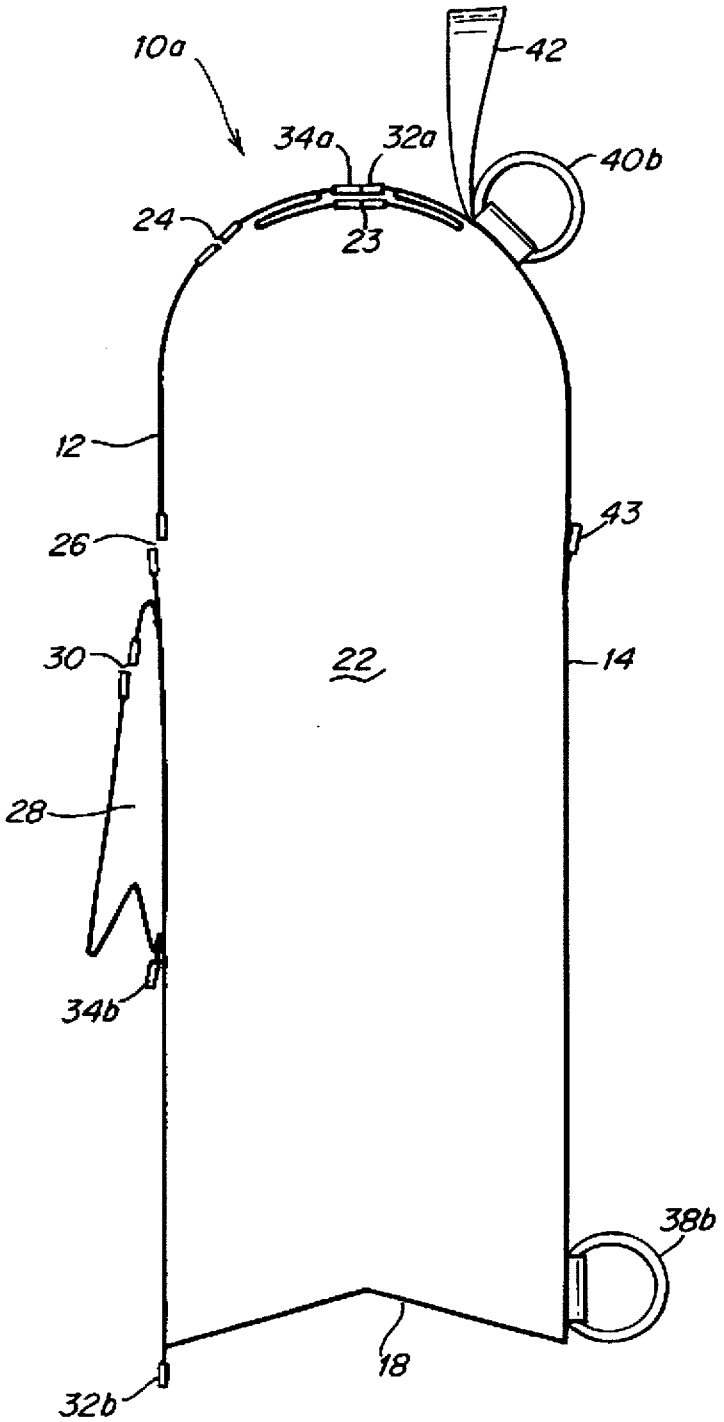
FIG. 2B is a partial schematic showing a cross-section of the backpack of FIG. 2A along line 2*b*—2*b* of FIG. 2A.

A modified form **10*a*** of the backpack is shown in FIG. 2A and FIG. 2B, which is a schematic showing a cross-section of the backpack of FIG. 2A along line 2*b*—2*b*. Like numbers in this embodiment identify components similar to those in FIGS. 1A to 1C. As is shown in FIGS. 2A and 2B, zipper portion **32*a* is mated with zipper portion 34*a* in order to provide the backpack with a neater profile by connecting the top edges of front panel 12 and rear panel 14**.

Figure 3:
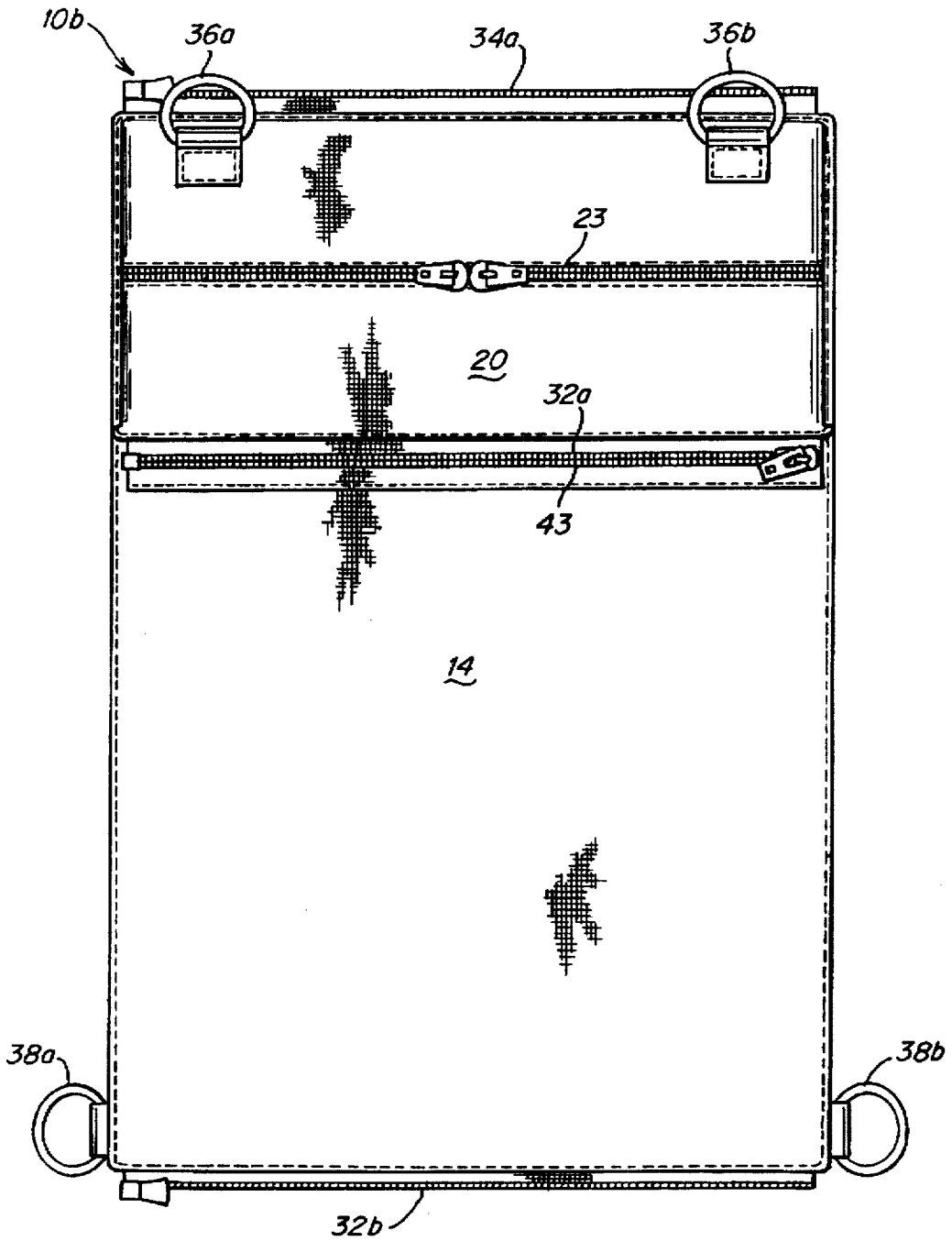
FIG. 3 is a schematic of another modified form of the backpack.

Another modified form **10*b* of the backpack is shown in FIG. 3. Again, like numbers in this embodiment identify components similar to those in FIGS. 1A-1C. As shown in FIG. 3, the top part of rear panel 14 is folded over itself and zipper portion 32*a* is mated with zipper portion 43. This configuration provides the backpack with a flatter profile by connecting the rear edge of top panel 20 to rear panel 14. When the backpack is in this configuration, rings 40*a* and 40*b* and loop 42 are hidden between the folded portions of rear panel 14 behind zipper portions 32*a* and 43. A strap may be connected between rings 36*a* and 36*b* so that the backpack may be used as a large shoulder bag. Alternatively, a pair of straps also may be connected between rings 36*a* and 38*a* and between rings 36*b* and 38*b*** for use as a backpack.

Figure 4:
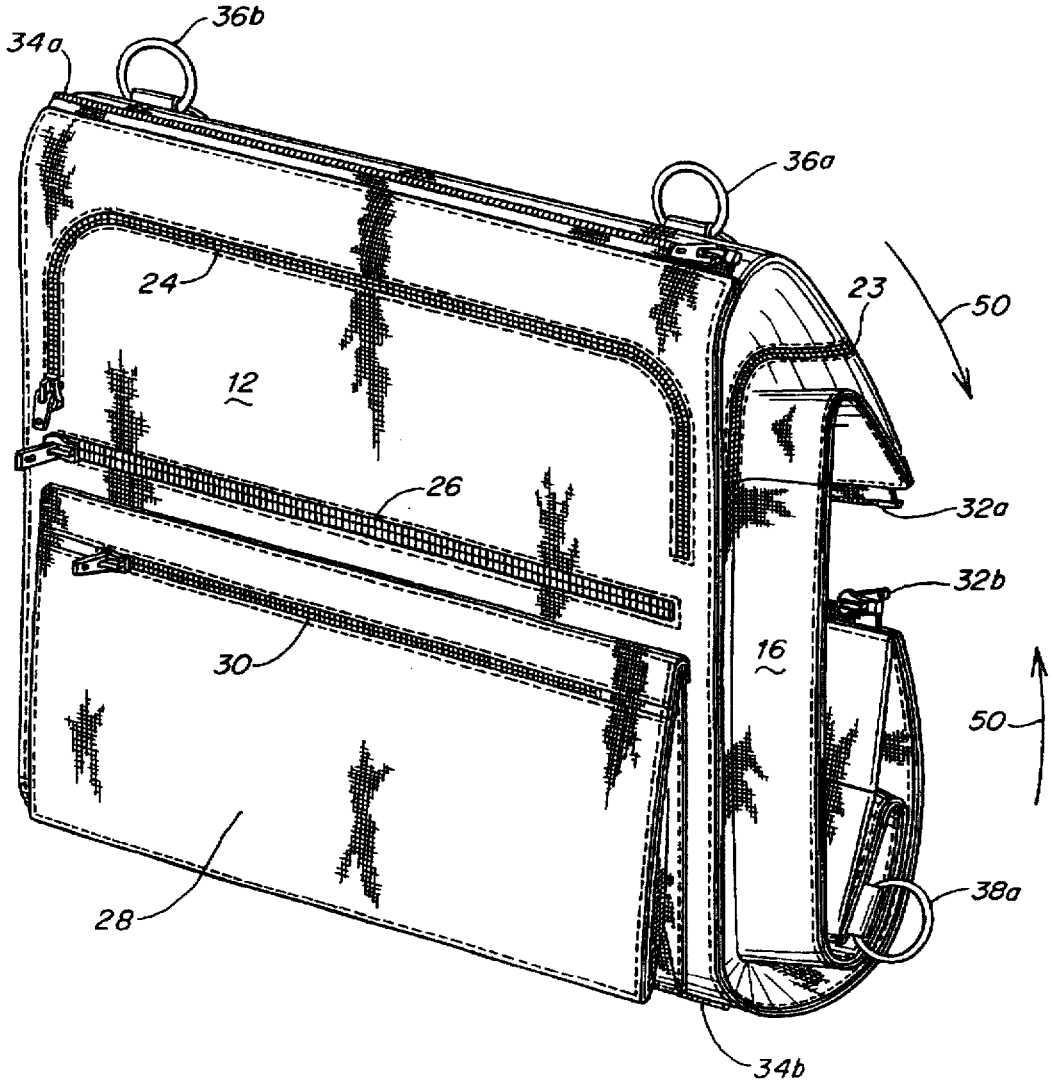
FIG. 4 is a schematic showing how the bag is converted from the backpack configuration to the totebag configuration according to the present invention.

When the backpack is to be converted into a totebag, straps **44*a* and 44*b* are removed, and the backpack is folded twice, as shown by arrows 50 in FIG. 4. If the backpack is in form 10*a*, FIG 4A, zipper portion 32*a* first must be disengaged from zipper portion 34*a* Similarly, if the backpack is in form 10*b*, FIG. 3, zipper portion 32*a* first must be disengaged from zipper portion 43. Zipper portion 32*a* then is mated with zipper portion 32*b*** to form the totebag shown in FIGS. 5A and FIG. 5B. FIG. 5B is a schematic showing a cross-section of the totebag of FIG. 5A along line 5*b*—5*b*. Zippered opening 24 is now located near the top of the bag and rear panel 14 is now within a compartment defined by top panel 20 and front panel 12. Rings **40*a* and 40*b* and loop 42 are hidden between the folded portions of rear panel 14 behind zipper portions 32*a* and 32*b*. A strap 54 may be connected between rings 36*a* and 36*b* to act as a shoulder strap for totebag 52. Alternatively, strap 56*a* may be attached between ring 36*a* and ring 38*a* and strap 56*b* may be attached between ring 36*b* and ring 38*b* so that totebag 52** may be worn on the back as a backpack.

Figure 6A:
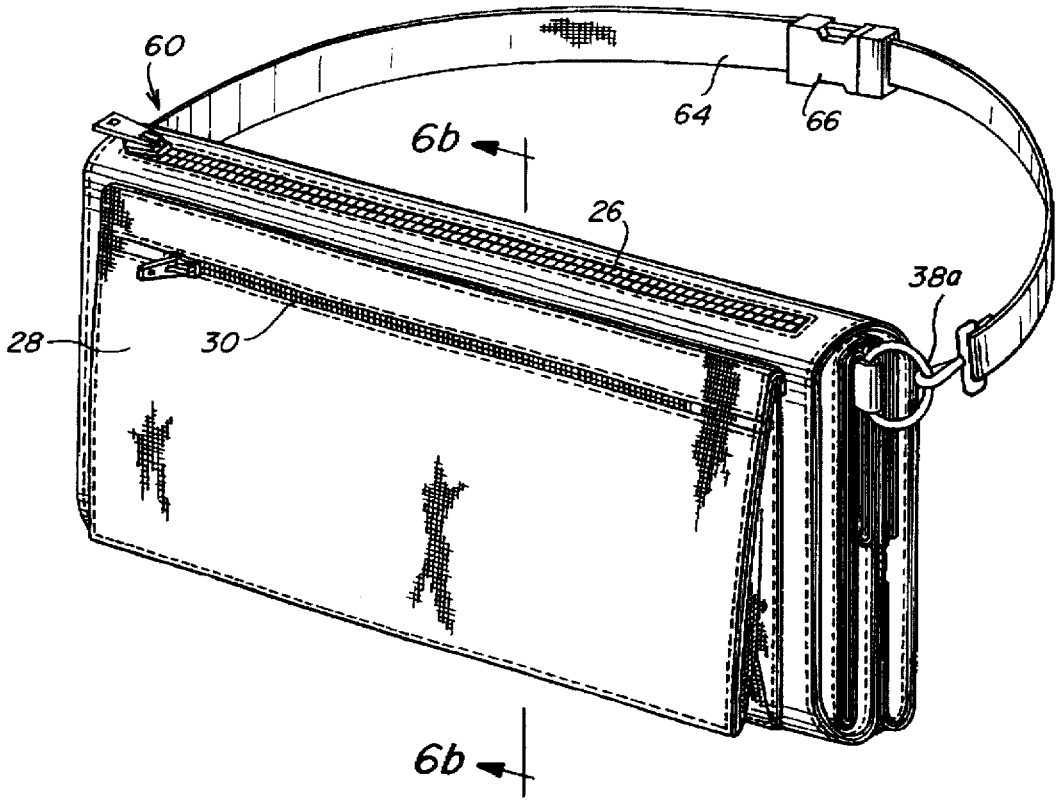
FIG. 6A is a schematic of the bag in its fanny pack configuration.
Figure 6B:
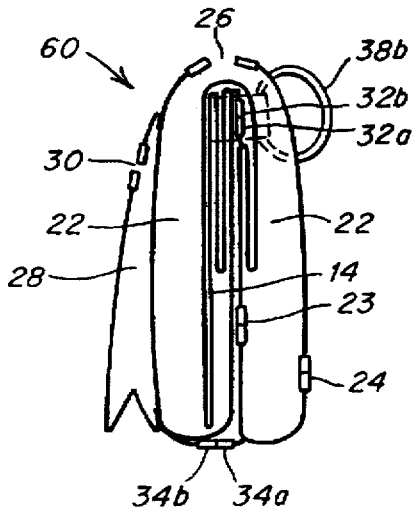
FIG. 6B is a partial schematic showing a cross-section of the fanny pack of FIG. 6A along line 6*b*—6*b* of FIG. 6A.

When totebag 52 is to be converted into fanny pack 60 shown in FIGS. 6A and FIG. 6B, which is a schematic showing a cross-section of fanny pack 60 along line 6*b*—6*b* of FIG. 6A, totebag 52 is folded in half, away from gussetted pocket 28. Zipper portion **34*a* then is mated with zipper portion 34*b*. As can be seen in FIG. 6A and FIG. 6B, zippered opening 26 is now on top of fanny pack 60, thus allowing access to interior compartment 22 which is now divided into two parts by the folded rear panel 14 and top panel 20, either side of which is accessible from the zippered opening 26. Rings 36***a* and 36*b* are hidden between top panel 20 and the bottom of front panel 12 behind zipper portions 34*a* and 34*b*. In this form, only the rings necessary for use as a fanny pack (rings 38*a* and 38*b*) are exposed. Rings 36*a*, 36*b*, 40*a* and 40*b* are all hidden out of sight. A belt 64 is attached between rings 38*a* and 38*b* to allow the fanny pack to be worn about the waist. An optional buckle 66 may be used to facilitate the strapping of the fanny pack about the waist. Gussetted pocket 28 is located on the front of fanny pack 60 with zippered opening 30 being located near the top of the fanny pack.

Figure 5A:
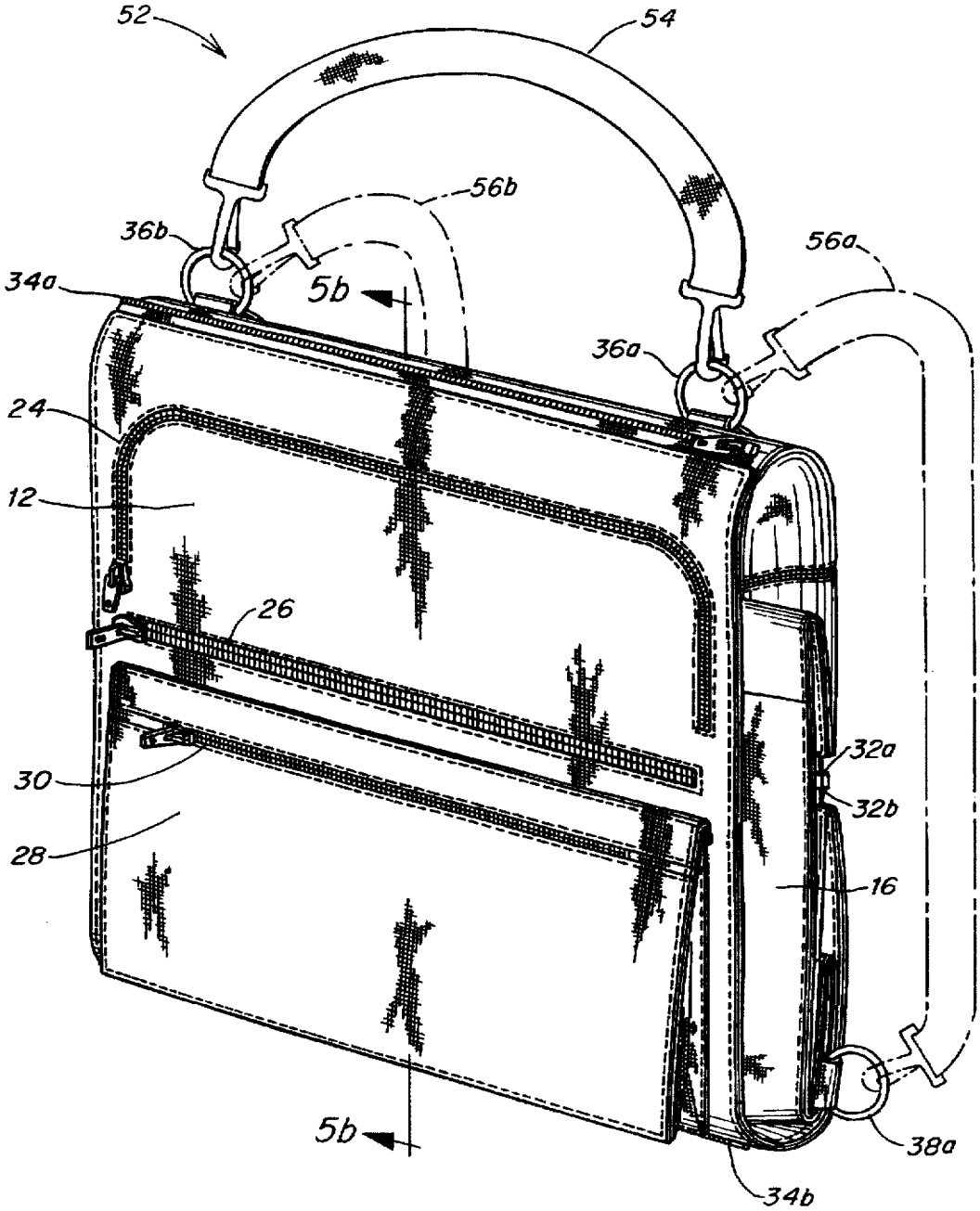
FIG. 5A is a schematic of the bag in its totebag configuration.
Figure 5B:
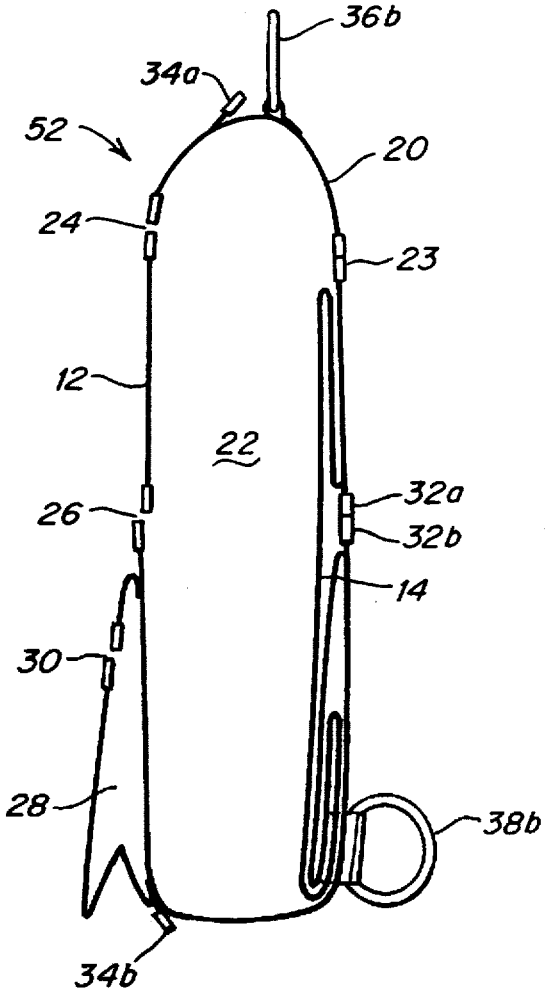
FIG. 5B is a partial schematic showing a cross-section of the totebag of FIG. 5A shown along line 5*b*—5*b* of FIG. 5A.

When fanny pack 60 is to be converted back to totebag 52, zipper portion 34*a* is disengaged from zipper portion 34*b* and fanny pack 60 is unfolded so that rings 36*a* and 36*b* are located at the top of the totebag 52 as shown in FIGS. 5A-5B. The appropriate straps 54 or 56*a*and 56*b* may then be attached. When totebag 52 is to be converted to backpack 10, zipper portion 32*a* is disengaged from zipper portion 32*b* and totebag 52 is unfolded in directions opposite the directions of arrows 50 of FIG. 4 in order to form backpack 10 of FIG. 1A. The appropriate straps 44*a* and 44*b* may be attached at this point.

In a preferred embodiment, the bag is made from a nylon material, however, the bag may be made of any material suitable for luggage or lightweight hand-carried baggage, such as cotton or canvas. The zippers and rings may be made from plastic, metal or any other suitable material and the carrying straps may be made of nylon and may be padded or unpadded. The straps may include buckle fasteners, D-ring type fasteners, VELCRO fasteners or any other type of fastener which would suitable for hand-carried baggage.

Having thus described an embodiment of the invention, various alterations, modifications, and improvements will readily occur to those skilled in the art. Such alterations, modifications and improvements are intended to be within the spirit and scope of the invention. Accordingly, the foregoing description is by way of example only and is not intended to be limiting.

What is claimed is:

1. A backpack which is convertible to a totebag and to a fanny pack, the backpack comprising:

parallel front and rear panels each having upper and lower edges, means for joining peripheries of said panels to form a compartment therebetween, at least one closeable opening in said front panel to allow access to said compartment, first fastening means disposed along the upper edge of said rear panel, second fastening means disposed along the lower edge of said front panel, third fastening means disposed along the upper edge of said front panel and fourth fastening means disposed on said front panel intermediate said second and third fastening means;

wherein said backpack is converted to said totebag when said first and second fastening means are fastened together proximate a midline of said rear panel, and further converted to said fanny pack when said totebag is folded in half and said third and fourth fastening means are fastened together.

2. The backpack of claim 1, further comprising first and second strap attachment means disposed near said upper and said lower edge of said rear panel, respectively, to allow a pair of shoulder straps to be attached between said first and second strap attachment means.

3. The backpack of claim 2, wherein said joining means is gussetted to allow said compartment to be expanded and collapsed between said front and rear panels.

4. The backpack of claim 3, wherein said joining means includes a closeable opening disposed between said upper edges of said front and rear panels.

5. The backpack of claim 4, further comprising a third strap attachment means disposed near the upper edge of said front panel to allow a shoulder strap of said totebag to be attached between said third strap attachment means.

6. The backpack of claim 5, wherein said third strap attachment means are attached to said joining means adjacent said third fastening means.

7. The backpack of claim 1, further comprising a gussetted pocket attached to said front panel intermediate said third and fourth fastening means.

8. The backpack of claim 1, wherein a profile of said backpack is modified by fastening together said first fastening means and said third fastening means.

9. The backpack of claim 1, further comprising fifth fastening means disposed on said rear panel between said upper and lower edges of said rear panel and parallel to said top edge.

wherein a profile of said backpack is modified by fastening together said first fastening means and said fifth fastening means.

10. A multi-use bag convertible into three configurations, the bag comprising parallel front and rear panels each having upper and lower edges, means for joining the panels along their peripheries to form a compartment therebetween, and at least one closeable opening in one of said panels for access to said compartment, said bag functioning as a backpack in an unfolded position;

means for fastening said upper and lower edges together proximate a midline of said rear panel, thereby forming a tote bag having an upper end, a lower end and at least one closeable opening for access to at least a portion of said compartment; and means for fastening said upper and lower ends of said tote bag together when said tote bag is folded in half, thereby forming a fanny pack having at least one closeable opening for access to at least a portion of said compartment.

11. The multi-use bag of claim 10 further comprising first and second strap attachment means disposed near said upper and said lower edge of said rear panel, respectively, to allow a pair of shoulder straps to be attached between said first and second strap attachment means.

12. The multi-use bag of claim 11 wherein said joining means is gussetted to allow said compartment to be expanded and collapsed between said front and rear panels.

13. The multi-use bag of claim 12 wherein said joining means includes a closeable opening disposed between said upper edges of said front and rear panels.

14. The multi-use bag of claim 13 further comprising a third strap attachment means disposed near the upper edge of said front panel to allow a shoulder strap of said totebag to be attached between said third strap attachment means.

15. A convertible multi-use bag having parallel front and rear panels, means joining the panels along their respective peripheries and defining a backpack compartment having an upper and lower end and a closeable opening in the compartment at the upper end thereof;

means for securing the upper and lower ends of the bag together to form a tote bag compartment when the upper and lower ends are folded toward one another, said securing means therefore including a means having one half at the upper end of the panels and the other half at the lower end of the panels; and means for securing the bag to form a fanny pack compartment when the front and rear panels are transversely folded with respect to the longitudinal axis of said bag, said securing means for said fanny pack compartment including a means having one half at the upper end of the panels and the other half intermediate the ends of the panels, and means forming a fanny pack on one of said panels intermediate its ends.

16. The multi-use bag of claim 15 further comprising first and second strap attachment means disposed near said upper and said lower end of said compartment, respectively, to allow a pair of shoulder straps to be attached between said first and second strap attachment means.

17. The multi-use bag of claim 16 wherein said joining means is gussetted to allow said compartment to be expanded and collapsed between said front and rear panels.

18. The multi-use bag of claim 17 wherein said joining means includes a closeable opening disposed at said upper end of said compartment.

19. The multi-use bag of claim 18 further comprising a third strap attachment means disposed near the upper end of said compartment to allow a shoulder strap of said totebag to be attached between said third strap attachment means.

20. A multipurpose bag selectively convertible to backpack, tote bag and fanny pack configurations comprising facing front and rear panels having upper and lower edges, means joining the panels along their peripheries to form a compartment therebetween, a first closeable opening in one of said panels for access to said compartment, said bag functioning as a backpack in an unfolded position;

means for securing said upper and lower edges together when the panels are folded whereby said bag functions as a tote bag having upper and lower edges, a second closeable opening in one of said panels for access to at least a portion of said compartment when in said tote bag configuration; and means for securing together the upper and lower edges defining said tote bag when the panels are multiply folded whereby the bag functions as a fanny pack, and means defining an accessible compartment when in said fanny pack configuration.

21. The backpack of claim 20 further comprising first and second strap attachment means disposed near said upper and said lower edge of said rear panel, respectively, to allow a pair of shoulder straps to be attached between said first and second strap attachment means.

22. The backpack of claim 21 wherein said joining means is gussetted to allow said compartment to be expanded and collapsed between said front and rear panels.

23. The backpack of claim 22 wherein said joining means includes a closeable opening disposed between said upper edges of said front and rear panels.

24. The backpack of claim 23 further comprising a third strap attachment means disposed near the upper edge of said front panel to allow a shoulder strap of said totebag to be attached between said third strap attachment means.

25. A method for converting a backpack into a tote bag and a fanny pack, the backpack having parallel front and rear panels each having upper and lower edges, said panels being joined along a periphery of each panel to form a compartment therebetween which is accessible through at least one of said panels, the method comprising:

folding a top half of said rear panel in half;

folding a bottom half of said front and rear panels in half;

fastening said upper edge of said rear panel to said lower edge of said front panel proximate a midline of said backpack to form said tote bag, said tote bag having an access to at least a portion of said compartment;

folding said tote bag in half; and fastening said upper edge of said front panel to said front panel intermediate said upper and lower edge of said front panel to form said fanny pack, said fanny pack having an access to at least a portion of said compartment.

* * * * *